US005114007A

United States Patent [19]

Chen

[11] Patent Number: 5,114,007

[45] Date of Patent: May 19, 1992

[54] TOOL BOX WITH DRAWER MEMBER

[75] Inventor: Chang Chen, Taichung Hsien, Taiwan

[73] Assignee: Tung I Enterprise Co., Ltd., Taichung Hsien, Taiwan

[21] Appl. No.: 674,708

[22] Filed: Mar. 25, 1991

[51] Int. Cl.[5] ..... B65D 85/00

[52] U.S. Cl. ..... 206/373; 312/DIG. 33

[58] Field of Search ..... 206/372, 373; 312/DIG. 33

[56] References Cited

U.S. PATENT DOCUMENTS 4,768,651 9/1988 Lanius ..... 206/373 X

FOREIGN PATENT DOCUMENTS 858393 5/1940 France ..... 206/373

33253 3/1905 Switzerland ..... 312/DIG. 33

2228921 9/1990 United Kingdom ..... 206/372

*Primary Examiner*—William I. Price

*Attorney, Agent, or Firm*—Baker & Daniels

[57] ABSTRACT

Each of the first and second casing halves of a tool box has an inner wall provided with at least one tool-receiving recess. A first drawer member is slidably received in a rectangular cavity of the first casing half. The first drawer member has a bottom wall provided with a plurality of spaced pairs of substantially L-shaped elongated projections. A plurality of positioning members engage the elongated projections and are used to arrange additional tools inside the first drawer member. The first casing half further has an inner wall provided with a rectangular depression, and a side wall provided with a notch to access the depression. A second drawer member is slidably received in the depression via the notch. The second drawer member confines at least one compartment to recieve fastener pieces and the like. A cover member is provided over the open top of the second drawer member to prevent the fastener pieces from spilling.

4 Claims, 4 Drawing Sheets

TOOL BOX WITH DRAWER MEMBER

BACKGROUND OF THE INVENTION

1. Field Of The Invention

The invention relates to a tool box, more particularly to a tool box having a drawer member to receive additional tools and other miscellaneous items.

2. Description Of The Related Art

FIG. 1 is a top view of a conventional tool box when in a fully opened position. The conventional tool box has a number of receiving spaces for receiving a corresponding number of tools of different shapes and sizes. A main disadvantage of the above described tool box is that it has no provisions for receiving additional tools. Thus, these additional tools would have to be carried separately, thereby inconveniencing the user. Another disadvantage of the conventional tool box is that it does not provide for a receiving space to receive fastener pieces such as nails, nuts, bolts, etc. The fastener pieces must thus be placed in a separate container.

SUMMARY OF THE INVENTION

Therefore, the objective of the present invention is to provide a tool box having at least one drawer member to receive additional tools and fastener pieces such as nuts, nails, bolts, etc.

Accordingly, the preferred embodiment of a tool box of the present invention comprises a first casing half, a second casing half hinged to the first casing half, a fastening means to fasten the first casing half to the second casing half, and a handle provided on at least one of the first and the second casing halves. Each of the first and second casing halves has an inner wall provided with at least one tool-receiving recess.

The first casing half has a rectangular cavity to slidably receive a first rectangular drawer member. The first drawer member has a bottom wall provided with a plurality of spaced pairs of substantially L-shaped elongated projections, each pair of elongated projections defining therebetween an elongated groove. A plurality of ribbed positioning members engage the elongated projections with a degree of tightness sufficient to resist unforced movement of the positioning members along the elongated grooves. The positioning members are used to arrange additional tools inside the first drawer member.

The first casing half further has an inner wall provided with a rectangular depression, and a side wall provided with a notch to access the depression. A second rectangular drawer member is slidably received in the depression via the notch. The second drawer member confines at least one compartment and has an open top. A transparent cover member is provided over the open top to prevent fastener pieces received in the second drawer member from spilling.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
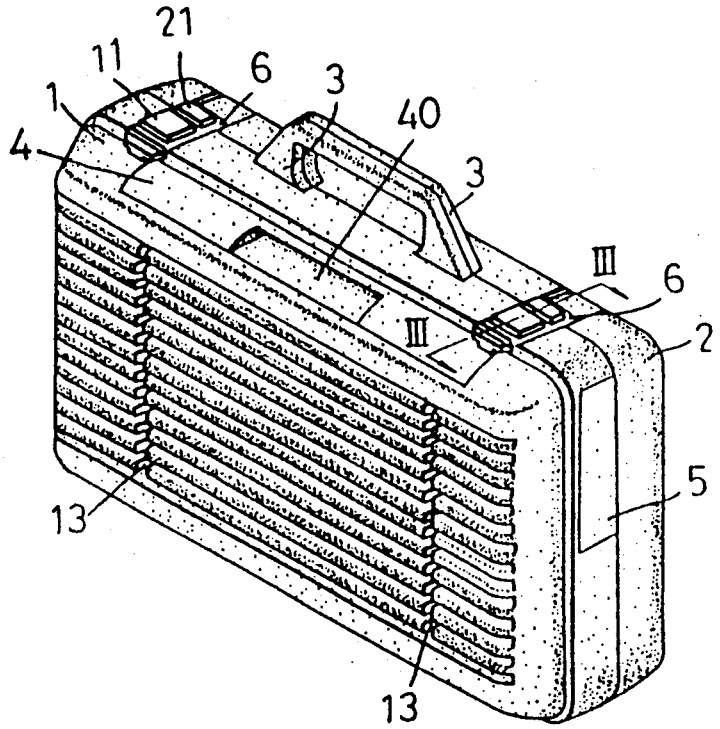
FIG. 2 is a perspective view of the preferred embodiment of a tool box with drawer member according to the present invention when in a closed position.

Referring to FIG. 2, the preferred embodiment of a tool box with drawer member according to the present invention is shown to comprise a first rectangular casing half 1 and a second rectangular casing half 2. The bottom sides of the first and second casing halves, 1 and 2, are hinged to one another. The top sides of the first and second casing halves, 1 and 2, are each provided with an outwardly extending inverted U-shaped projection 3 which cooperatively form a handle for the preferred embodiment. The preferred embodiment further comprises first and second rectangular drawer members, 4 and 5, slidably received in the first casing, half 1. The first drawer member 4 has a groove 40 to facilitate drawing of the first drawer member 4 away from the first casing half 1.

Figure 1:
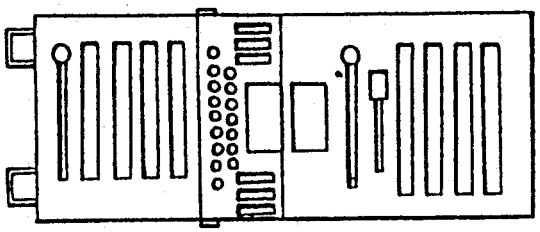
FIG. 1 (PRIOR ART)
FIG. 1 is a top view of a conventional tool box when in a fully opened position.
Figure 3:
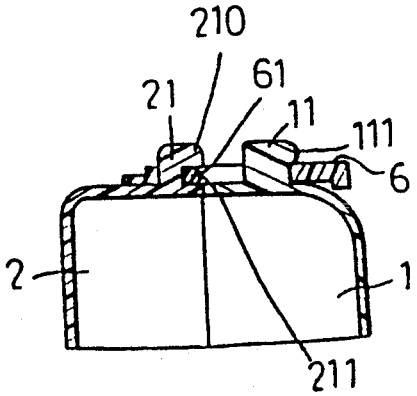
FIG. 3 is a section taken along line III—III of FIG. 2 to illustrate a fastener means of the preferred embodiment used to releasably secure the casing halves of the same.

The first and second casing halves, 1 and 2, each have a pair of fastening projections, and 21, respectively disposed on either side of the handle. A pair of looped resilient fasteners 6 engage the fastening projections, 11 and 21, and maintain the first and second casing halves, 1 and 2, in the closed position shown in FIG. 2. Referring to FIG. 3, the fastening projection 21 has a bent portion 210 which cooperates with the top side of the second casing half 2 to define a notch 211. The fastener 6 has an elongated rod portion 61 extending to the vicinity of the central portion thereof and press fitted into the notch 211 to fix the fastener 6 to the fastening projection 21. The fastener 6 detachably engages the fastening projection 11. The fastening projection 11 has a rounded protrusion 111 to prevent untimely detachment of the fastener 6 from the fastening projection 11.

Figure 4:
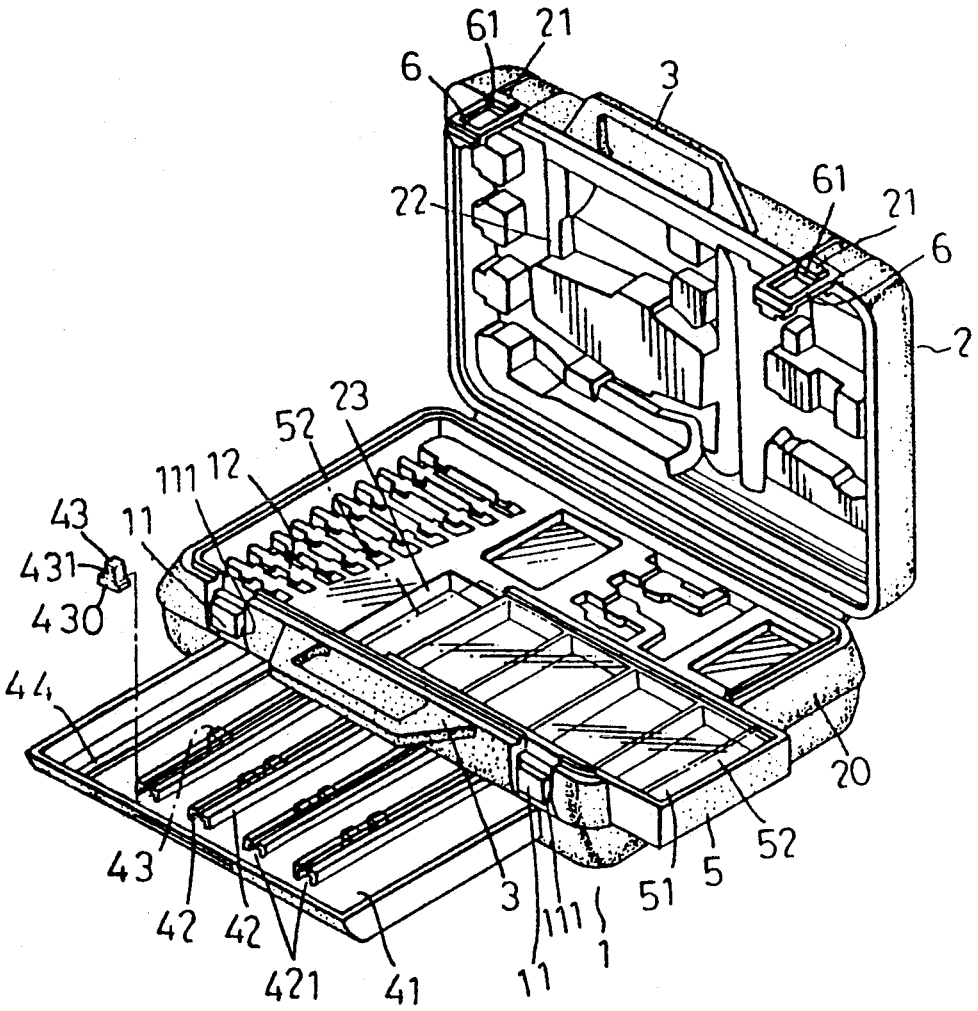
FIG. 4 is a perspective view of the tool box with drawer member of the preferred embodiment when in an open position.

Once the fastener 6 has been detached from the fastening projection 11, the second casing half 2 can be rotated, relative to the first casing half 1, from the closed position in FIG. 2, to the open position shown in FIG. 4. Each of the first and second casing halves, 1 and 2, has an inner wall provided with a plurality of tool-receiving recesses, 12 and 22, respectively. The inner wall of the first casing half 1 is provided with a rectangular depression 23. The first casing half 1 has a side wall 20 provided with a notch to access the depression 23. The second drawer member 5 is slidably received in the depression 23 via the notch of the side wall 20. The second drawer member 5 confines a plurality of rectangular compartments 51. A transparent cover 52 is slidably provided on the open top of the second drawer member 5.

The first drawer member 4 is slidably received in a rectangular cavity of the first casing half 1. The first drawer member 4 has a bottom wall 41 provided with several spaced pairs of substantially L-shaped elongated projections 42. Each pair of elongated projections 42 defines therebetween an elongated groove 421 which has a narrow upper portion and a wide lower portion. Each of a plurality of positioning members 43 has an enlarged head portion 430 received in the lower portion of one of the elongated grooves 421 and a restricted ribbed portion 431 extending upward from the head portion 430 and through the upper portion of the corresponding elongated groove 421. The positioning members 43 engage the elongated projections 42 with a degree of tightness sufficient to resist unforced movement of the positioning members 43 along the elongated grooves 421. The positioning members 43 are used to arrange additional tools (i.e., tools which do not a have designated space in either of the tool receiving recesses, 12 and 22) inside the first drawer member 4. The restricted ribbed portion 431 of the positioning members 43 provide friction between the tools and the positioning members 43.

Figure 5:
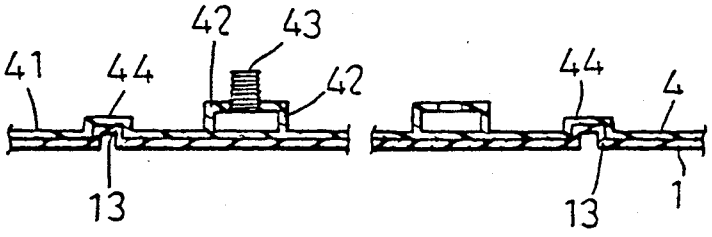
FIG. 5 is a sectional view illustrating the relationship between a drawer member of the preferred embodiment and one of the casing halves.

Referring to FIGS. 2, 4 and 5, the first casing half has a pair of inwardly projecting elongated first guide rails 13. The bottom wall 41 of the first drawer member 4 is provided with a pair of inwardly projecting elongated second guide rails 44. The width of the first guide rails 13 matches the width of an elongated groove defined by the second guide rail 44 to permit sliding engagement between the first drawer member 4 and the first casing half 1.

The advantages of using the preferred embodiment are as follows:

1. Tools which cannot be accommodated by the tool receiving spaces, 12 and 22, of the first and second casing halves, 1 and 2, can be placed inside the first drawer member 4. The elongated projections 42 and the positioning members 43 facilitate arrangement of tools inside the first drawer member 4.

2. The second drawer member 5 of the preferred embodiment has rectangular compartments 51 that provide receiving spaces to facilitate sorting and storage of fastener pieces and other similar small articles. The transparent cover 52 prevents the articles confined by the rectangular compartments 51 from spilling.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A tool box comprising a first casing half, a second casing half hinged to said first casing half, each of said first and said second casing halves having an inner wall provided with at least one tool-receiving recess, a fastening means to fasten said first casing half to said second casing half, and a handle provided on at least one of said first and second casing halves, characterized in that:

said tool box further comprises a rectangular first drawer member;

one of said first and second casing halves has a rectangular cavity to slidably receive said first drawer member, said first drawer member having a bottom wall provided with a plurality of spaced pairs of substantially L-shaped elongated projections, each said pair of elongated projections defining therebetween an elongated groove which has a narrow upper portion and a wide lower portion, and a plurality of positioning members each having an enlarged head portion received in said lower portion of one of said elongated grooves and a restricted portion extending upward from said head portion and through said upper portion of said one elongated groove, said positioning members engaging said elongated projections with a degree of tightness sufficient to resist unforced movement of said positioning members along said elongated grooves, whereby said positioning members are used to arrange additional tools inside said first drawer member.

2. The tool box as claimed in claim 1, wherein said restricted portion of each said positioning member is ribbed to provide friction between the additional tools and said positioning member.

3. A tool box comprising a first casing half, a second casing half hinged to said first casing half, each of said first and said second casing halves having an inner wall provided with at least one tool-receiving recess, a fastening means to fasten said first casing half to said second casing half, and a handle provided on at least one of said first and second casing halves, characterized in that:

said tool box further comprises a rectangular first drawer member;

one of said first and second casing halves has a rectangular cavity to slidably receive said first drawer member, said inner wall of one of said first and second casing halves having a rectangular depression, said one of said first and said second casing halves having a side wall provided with a notch to access said depression; and a second rectangular drawer member slidably received in said depression via said notch, said second drawer member confining at least one compartment and having an open top, and a cover member provided on said open top.

4. The tool box as claimed in claim 3, wherein said cover member is transparent.

* * * * *

UNITED STATES PATENT AND TRADEMARK OFFICE

CERTIFICATE OF CORRECTION

PATENT NO. : 5,114,007

DATED : May 19, 1992

INVENTOR(S) : Chang Chen

It is certified that error appears in the above-identified patent and that said Letters Patent is hereby corrected as shown below:

Claim 2, Column 4, Line 29, delete "member" and substitute therefore --members--.

Signed and Sealed this

Twentieth Day of July, 1993

*Attest:*

Michael K. Kirk

MICHAEL K. KIRK

*Attesting Officer*

*Acting Commissioner of Patents and Trademarks*